US011840102B2

(12) United States Patent
Demarchi et al.

(10) Patent No.: US 11,840,102 B2
(45) Date of Patent: Dec. 12, 2023

(54) METHOD FOR TREATING THE SURFACES OF A PART AND ASSOCIATED FACILITY

(71) Applicants: ROBO, Chambery (FR); SMRC AUTOMOTIVE HOLDINGS NETHERLANDS B.V., Amsterdam (NL)

(72) Inventors: Michel Demarchi, Culoz (FR); Jérome Boniface, Santes (FR)

(73) Assignees: ROBO, Chambery (FR); SMRC AUTOMOTIVE HOLDINGS NETHERLANDS B.V., Amsterdam (NL)

( * ) Notice: Subject to any disclaimer, the term of this patent is extended or adjusted under 35 U.S.C. 154(b) by 149 days.

(21) Appl. No.: 17/054,111

(22) PCT Filed: Mar. 13, 2019

(86) PCT No.: PCT/EP2019/056313

§ 371 (c)(1),
(2) Date: Nov. 9, 2020

(87) PCT Pub. No.: WO2019/219273

PCT Pub. Date: Nov. 21, 2019

(65) Prior Publication Data

US 2021/0402799 A1 Dec. 30, 2021

(30) Foreign Application Priority Data

May 14, 2018 (FR) ..... 18 54024

(51) Int. Cl.
*B41J 3/407* (2006.01)
*B41J 11/00* (2006.01)

(52) U.S. Cl.
CPC ..... *B41J 3/4073* (2013.01); *B41J 11/00214* (2021.01)

(58) Field of Classification Search
None
See application file for complete search history.

(56) References Cited

U.S. PATENT DOCUMENTS 9,981,484 B1 * 5/2018 Moore ..... B41M 5/0011
2001/0017085 A1 8/2001 Kubo et al.
(Continued)

FOREIGN PATENT DOCUMENTS

DE 102012212469 1/2014
JP 2011-101838 5/2011
(Continued)

OTHER PUBLICATIONS

International Search Report dated Jun. 5, 2019.
Japanese Office Action dated Feb. 1, 2023.
Indian Search Report dated May 24, 2022.

*Primary Examiner* — Erica S Lin
(74) *Attorney, Agent, or Firm* — IPSILON USA, LLP

(57) ABSTRACT

The present invention relates to a method for surface-treating a part (2), comprising:

a measurement step, during which movement means (3), to which the part (2) is secured, are moved and a set of instantaneous velocities, at the surface (1) of the part (2), is determined by means of a measurement sensor (9), a signal processing step, during which a microcontroller (8) determines, from the data representative of the set of instantaneous velocities, a pulse train signal (S) representative of a set of frequencies of ejection of a substance (13) to be deposited, a deposition step, during which the microcontroller (8) transmits the pulse train signal (S) to the deposition means (6) in order to eject the substance (13) according to the pulse train signal (S).

22 Claims, 6 Drawing Sheets

(56) References Cited

U.S. PATENT DOCUMENTS

| | | | | |
|---|---|---|---|---|
| 2004/0189964 | A1* | 9/2004 | Nijmeijer | G03F 9/7026 355/55 |
| 2010/0262283 | A1* | 10/2010 | Ayers | B25J 9/1085 700/245 |
| 2015/0042716 | A1 | 2/2015 | Beier et al. | |
| 2016/0263920 | A1 | 9/2016 | Moehringer et al. | |
| 2017/0066232 | A1* | 3/2017 | Litvinov | B41J 3/4073 |
| 2018/0080841 | A1* | 3/2018 | Cordoba | A61B 34/37 |

FOREIGN PATENT DOCUMENTS

| | | |
|---|---|---|
| JP | 2013123897 | 6/2013 |
| JP | 2016-215438 | 12/2016 |
| JP | 2017019213 | 1/2017 |

* cited by examiner

| i | Tscrut i (ms) | Ti (µs) |
|---|---|---|
| 1 | Tscrut i | 166.4 |
| 2 | Tscrut i +1 | 163.2 |
| 3 | Tscrut i +2 | 168.5 |
| 4 | Tscrut i +3 | 170.6 |
| 5 | Tscrut i +4 | 171.2 |

METHOD FOR TREATING THE SURFACES OF A PART AND ASSOCIATED FACILITY

RELATED APPLICATION

This application is a National Phase of PCT/EP2019/056313 filed on Mar. 13, 2019 which claims the benefit of priority from French Patent Application No. 18 54024, filed on May 14, 2018, the entirety of which are incorporated by reference.

FIELD OF THE INVENTION

The present invention relates to the field of the surface treatment of parts, and preferentially of the printing of parts by inkjet-type printing means.

DESCRIPTION OF RELATED ART

In a known manner and as illustrated, for example, in the publications DE 10 2012 212 469 A1, US 2009/0167817 A1, EP 2 873 496 A1, and EP 0 931 649 A1, in order to print a part by inkjet-type printing means, the printhead which ejects a substance, such as ink, can be moved by a robot arm relative to a part which remains fixed. However, the printing means, which most often incorporate a four-color assembly, are generally bulky, and it is then not very easy to move them. This is all the more true when these printing means are, in addition, associated with a module for partially drying the drops of the substance, arranged directly beneath the printhead. In addition, the printheads can be subject to disruptions or to variations in position due to the rapid movement of the robot arm. To limit these disruptions, it is then necessary to limit the speed of movement of the robot arm, which reduces the rate and the industrial efficiency. Furthermore, sudden variations in the orientation of the printhead result in the quality of printing being affected. Specifically, inside the printhead, the air is at slight low pressure in order to prevent the substance from flowing due to gravity. However, sudden variations in orientation have the consequence of changing the balance between atmospheric pressure and the pressure inside the printhead, and therefore of disrupting the ejection of the substance. Finally, it is also difficult to install the substance feed unit of the printhead on the robot arm.

OBJECTS AND SUMMARY

The object of the present invention is to propose an improved solution, which is flexible according to the geometry of the part, making it possible to obtain a high degree of precision regardless of the geometry of the part, and the aim of which is to overcome the aforementioned drawbacks.

To this end, the invention relates to a method for surface-treating at least one surface of a part, which method is characterized in that it comprises at least:

a measurement step, during which the movement means, to which the part is secured at the level of a support forming part of the movement means, are moved at a speed of movement that varies according to the local geometry of the part, along a predetermined trajectory and, in a controlled manner, by a management and control unit, relative to deposition means which are not ejecting any substance, and during which a set of instantaneous velocities, over at least a fraction of the surface of the part, is determined by means of a measurement sensor controlled by the management and control unit, then data representative of this set of instantaneous velocities are transmitted and recorded in a computer, a signal processing step, subsequent to the measurement step, during which a microcontroller determines, from the data representative of the set of instantaneous velocities that were previously transmitted by the computer to the microcontroller, a pulse train signal representative of a set of frequencies of ejection of a substance to be deposited by the deposition means on said at least a fraction of the surface of the part, and records the pulse train signal in a storage memory of the microcontroller, a deposition step, subsequent to the signal processing step, during which the movement means are moved in a controlled manner, by the management and control unit relative to the deposition means, along the determined trajectory, and during which, in a synchronized manner, the microcontroller transmits the pulse train signal to the deposition means, and the deposition means eject at least one substance according to the received pulse train signal in order to deposit the substance on said at least a fraction of the surface of the part.

The invention also relates to an installation for surface-treating at least one surface of a part, characterized in that it is capable of and intended for implementing the method for surface-treating at least one surface of a part according to the invention and in that it comprises:

movement means capable of and intended for moving the part relative to the deposition means, and the movement means comprising a support capable of and intended for fixing the part relative to the movement means, a management and control unit capable of and intended for controlling the movement of the movement means along a predetermined trajectory and according to a predetermined speed of movement, in a controlled manner, a measurement sensor capable of and intended for determining a set of instantaneous velocities over at least a fraction of the surface of the part, the deposition means being capable of and intended for ejecting a substance onto the surface of the part, a computer capable of and intended for receiving and recording data representative of the set of instantaneous velocities, a microcontroller capable of and intended for determining, from the data representative of the set of instantaneous velocities, a pulse train signal representative of a set of frequencies of ejection of the substance to be deposited by the deposition means, and for transmitting it to the deposition means in order to eject the substance according to the received pulse train signal.

BRIEF DESCRIPTION OF THE DRAWINGS

The invention will be better understood by virtue of the description below, which relates to several preferred embodiments, given by way of non-limiting examples, and explained with reference to the appended schematic drawings, in which.

DETAILED DESCRIPTION

Figures 3A, 3B:
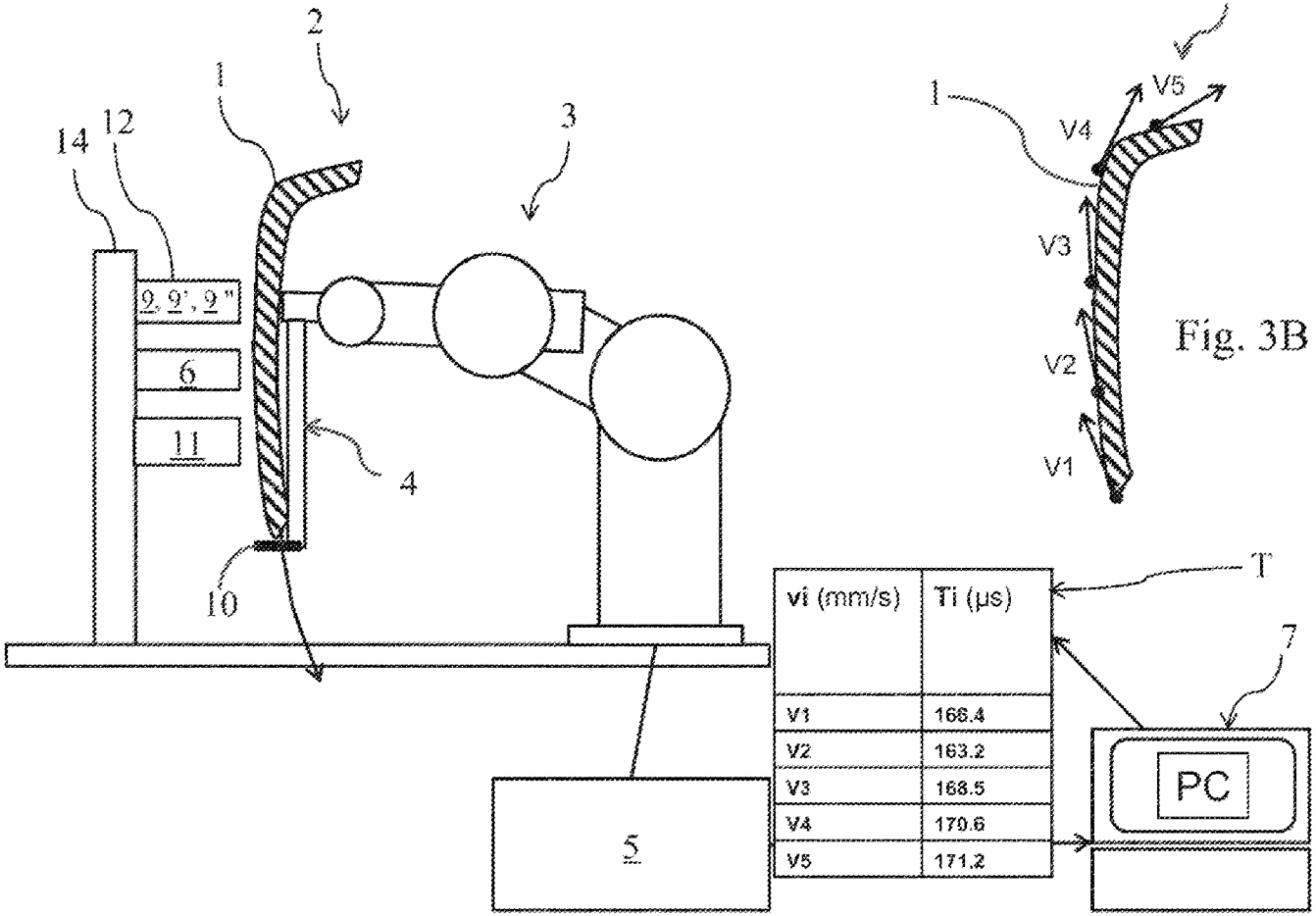
FIG. 3A is a view of the installation according to the invention, during the measurement step of the method according to the invention.
FIG. 3B is a view of the part on which the vectors of the instantaneous velocities are shown on the surface of the part.
Figure 4:
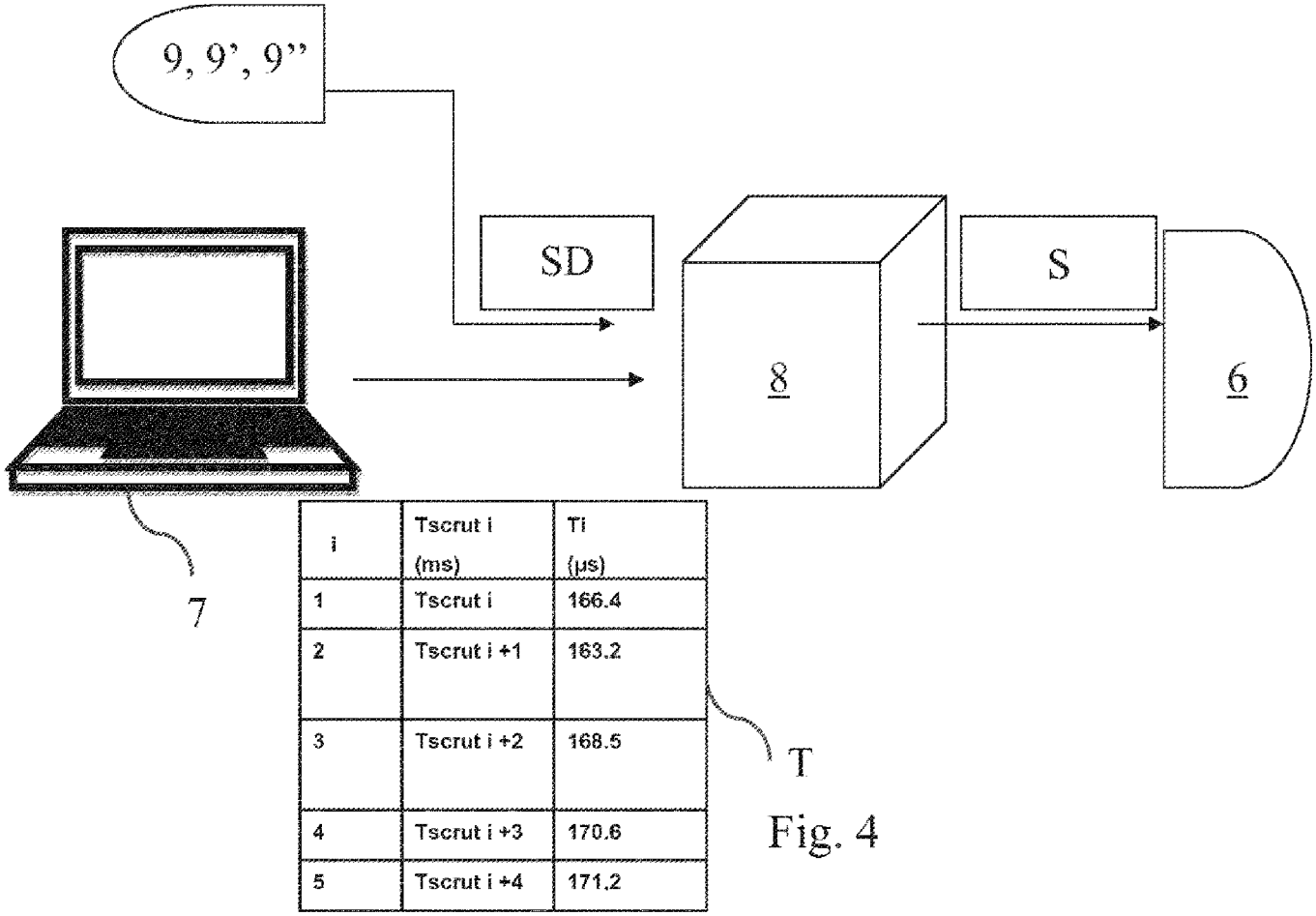
FIG. 4 is a schematic view illustrating the method according to the invention.
Figures 5A, 5B:
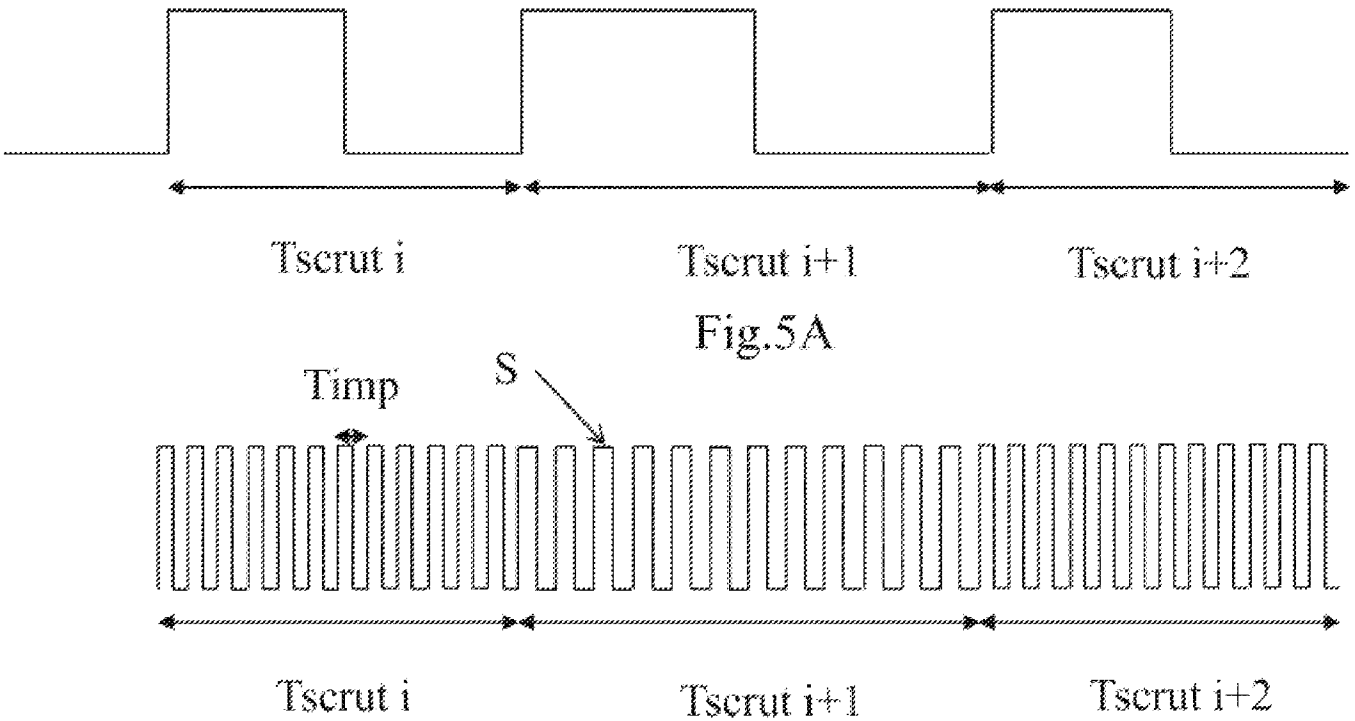
FIGS. 5A and 5B are views of the signals obtained during the signal processing step of the method according to the invention.
Figure 6:
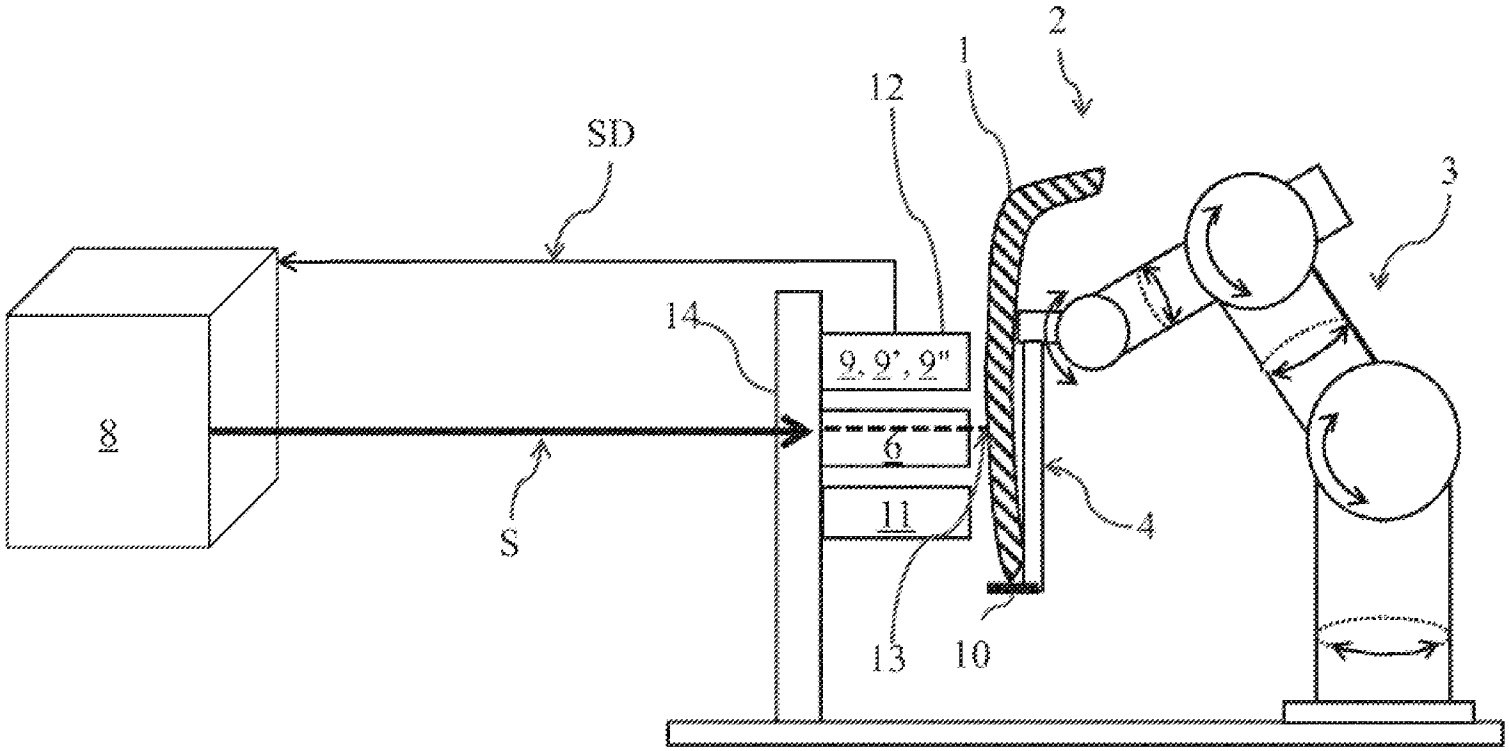
FIG. 6 is a view of the installation, during the deposition step of the method according to the invention.

According to the invention, the method for surface-treating at least one surface 1 of a part 2 is characterized in that it comprises at least:

- a measurement step, during which movement means 3, to which the part 2 is secured at the level of a support 4 forming part of the movement means 3, are moved at a speed of movement that varies according to the local geometry of the part 2, along a predetermined trajectory and, in a controlled manner, by a management and control unit 5, relative to deposition means 6 which are not ejecting any substance 13, and during which a set of instantaneous velocities v1, v2, v3, v4, v5, over at least a fraction of the surface 1 of the part 2, is determined by means of a measurement sensor 9 controlled by the management and control unit 5, then data representative of this set of instantaneous velocities v1, v2, v3, v4, v5 are transmitted and recorded in a computer 7 (FIGS. 3A and 3B),
- a signal processing step, subsequent to the measurement step, during which a microcontroller 8 determines, from the data representative of the set of instantaneous velocities v1, v2, v3, v4, v5 that were previously transmitted by the computer 7 to the microcontroller 8, a pulse train signal S representative of a set of frequencies of ejection of a substance 13 to be deposited by the deposition means 6 on said at least a fraction of the surface 1 of the part 2, and records the pulse train signal S in a storage memory (not shown) of the microcontroller 8 (FIGS. 4 and 5B),
- a deposition step, subsequent to the signal processing step, during which the movement means 3 are moved in a controlled manner, by the management and control unit 5 relative to the deposition means 6, along the determined trajectory, and during which, in a synchronized manner, the microcontroller 8 transmits the pulse train signal S to the deposition means 6, and the deposition means 6 eject at least one substance 13 according to the received pulse train signal S in order to deposit the substance 13 on said at least a fraction of the surface 1 of the part 2 (FIGS. 4 and 6).

This treatment method advantageously allows a part 2 to be decorated by creating a pattern (not shown) by depositing at least one substance 13 using deposition means 6. Due to the geometry of the part 2, it is generally necessary to vary the speed of movement of the part 2 and therefore that of the movement means 3 in order to avoid collisions with the deposition means 6 during movement and in order to deposit the substance 13 while taking care to correct for the variations in speed of the movement means 3. By virtue of the treatment method according to the invention, this variability in the speed of movement of the movement means 3 does not affect the quality of the decoration obtained upon completion of the treatment method according to the invention. Advantageously, in the treatment method according to the invention, the instantaneous velocities v1, v2, v3, v4, v5 of the part 2 are measured prior to the deposition step, on a predetermined trajectory, during the measurement step. Next, these instantaneous velocities v1, v2, v3, v4, v5 are stored in a computer 7. Preferably, the instantaneous velocities v1, v2, v3, v4, v5 may be stored in the form of a table T of instantaneous velocities v1, v2, v3, v4, v5. By virtue of the repeatability of the movement means 3, it is possible to move the part 2 again and again along the same predetermined trajectory and according to the same kinematics, that is to say the same speed of movement, which may be variable or constant, and in particular during the deposition step. On the basis of these instantaneous velocities v1, v2, v3, v4, v5 stored in the computer 7, then transmitted to the microcontroller 8, it is further then possible to generate a pulse train signal S. During the deposition step, and therefore at the same time as the part 2 is moved by the movement means 3 along the predetermined trajectory, this pulse train signal S is transmitted to the deposition means 6. Thus, the treatment of the part 2 by the deposition means 6 is matched to the instantaneous velocity v1, v2, v3, v4, v5 of the part 2. Specifically, the frequency of ejection of the drops of substance 13 by the deposition means 6 is advantageously correlated to the instantaneous velocity v1, v2, v3, v4, v5 of the part 2. The predetermined trajectory and the kinematics of the movement means 3 may, furthermore, be programmed in advance using software present in the management and control unit 5. This software, and the predetermined trajectory and the kinematics, can be modified according to the requirements and with a high degree of flexibility.

As a result, advantageously, this treatment method makes it possible to decorate parts 2 that have any type of geometry. Moreover, this treatment method makes it possible to freely position the pattern on the surface 1 of the part 2. This method thus makes it possible to obtain a high degree of precision in the patterns deposited and to do so in a constant and continuous manner, including in three-dimensional regions of the part 2, for example, radii, edges or the like.

The part 2 may be a three-dimensional part, for example a vehicle trim part, for example made of plastic.

The deposition step may comprise several passes of the surface 1 of the part 2 by the deposition means 6, in particular when large patterns have to be deposited on the surface 1 of the part 2. In this case, the measurement step may be performed in successive passes of the surface 1 of the part 2 by the measurement sensor 9 in order to scan the entire surface 1 of the part 2 intended to be decorated, for example strip by strip.

Preferably, during the measurement step, the management and control unit 5 and the measurement sensor 9 sequentially measure the instantaneous velocities v1, v2, v3, v4, v5, the various successive measurements being separated by a polling period Tscrut i, Tscrut i+1, Tscrut i+2, Tscrut i+3, Tscrut i+4 which is constant or variable, preferably between 1 microsecond and 100 milliseconds (FIGS. 3A and 3B).

Preferably, the acquisition of the instantaneous velocity v1, v2, v3, v4, v5 of the part 2 is carried out every 2 milliseconds.

Advantageously, this measurement step makes it possible to acquire the profile of instantaneous velocities v1, v2, v3, v4, v5 over the entire course of the trajectory at a polling period Tscrut i, Tscrut i+1, Tscrut i+2, Tscrut i+3, Tscrut i+4. This sampling of the profile of the instantaneous velocities v1, v2, v3, v4, v5 of the trajectory is carried out according to the polling period Tscrut Tscrut i+1, Tscrut i+2, Tscrut i+3, Tscrut i+4 which may be variable according to the desired speed for the part 2. The polling period Tscrut i, Tscrut i+1, Tscrut i+2, Tscrut i+3, Tscrut i+4 may vary over the trajectory in order to allow greater or lesser precision depending on the complexity of the contour of the part 2 to be followed.

The method according to the invention may comprise a conversion step, subsequent to the measurement step and prior to the signal processing step, during which the computer 7 converts the set of instantaneous velocities v1, v2, v3, v4, v5 into a series of pulse train periods T1, T2, T3, T4, T5, on the basis of the relationship Ti=(R/vi)/K, with i a natural integer, R the printing resolution in millimeters, preferably between 0.04 millimeters and 4 millimeters, K the oversampling coefficient, preferably between $10^6$ and $10^7$ (FIG. 4).

Advantageously, during the conversion step, the profile of instantaneous velocities v1, v2, v3, v4, v5 is converted by the computer 7 into series of pulse train periods T1, T2, T3, T4, T5 while observing the polling period Tscrut i, Tscrut i+1, Tscrut i+2, Tscrut i+3, Tscrut i+4. For example and as illustrated in FIG. 4, the value of T1 is 166.4 microseconds, the value of T2 is 163.2 microseconds, the value of T3 is 168.5 microseconds, the value of T4 is 170.6 microseconds and the value of T5 is 171.2 microseconds. The set of period values T1, T2, T3, T4, T5 may be placed in a table T, illustrated in FIG. 4.

Preferably, during the signal processing step, the series of pulse train periods T1, T2, T3, T4, T5 is transformed into a pulse train signal S sampled at a sampling period Timp, preferably between 5 microseconds and 100 microseconds, by the microcontroller 8 (FIGS. 5A and 5B).

Advantageously, during the signal processing step, the series of periods T1, T2, T3, T4, T5 is then converted by the microcontroller 8 into a periodic signal, preferably a square pulse train, compatible with the synchronization signal expected by the deposition means 6. Typically, the sampling period Timp may be decreased to about 50 microseconds. As a result, each value of the periods T1, T2, T3, T4, T5 is multiplied in order to create a pulse train signal S of sampling period Timp for the duration of the polling period Tscrut i. The same applies for each period Tscrut i+1, Tscrut i+2, Tscrut i+3, Tscrut i+4 transmitted by the computer 7. The pulse trains are then placed end to end by the microcontroller 8 in order to form the pulse train signal S. This pulse train signal S is stored in the storage memory (not shown) of the microcontroller 8.

The pulse train signal S may have a square edge (FIG. 5B).

Figure 1:
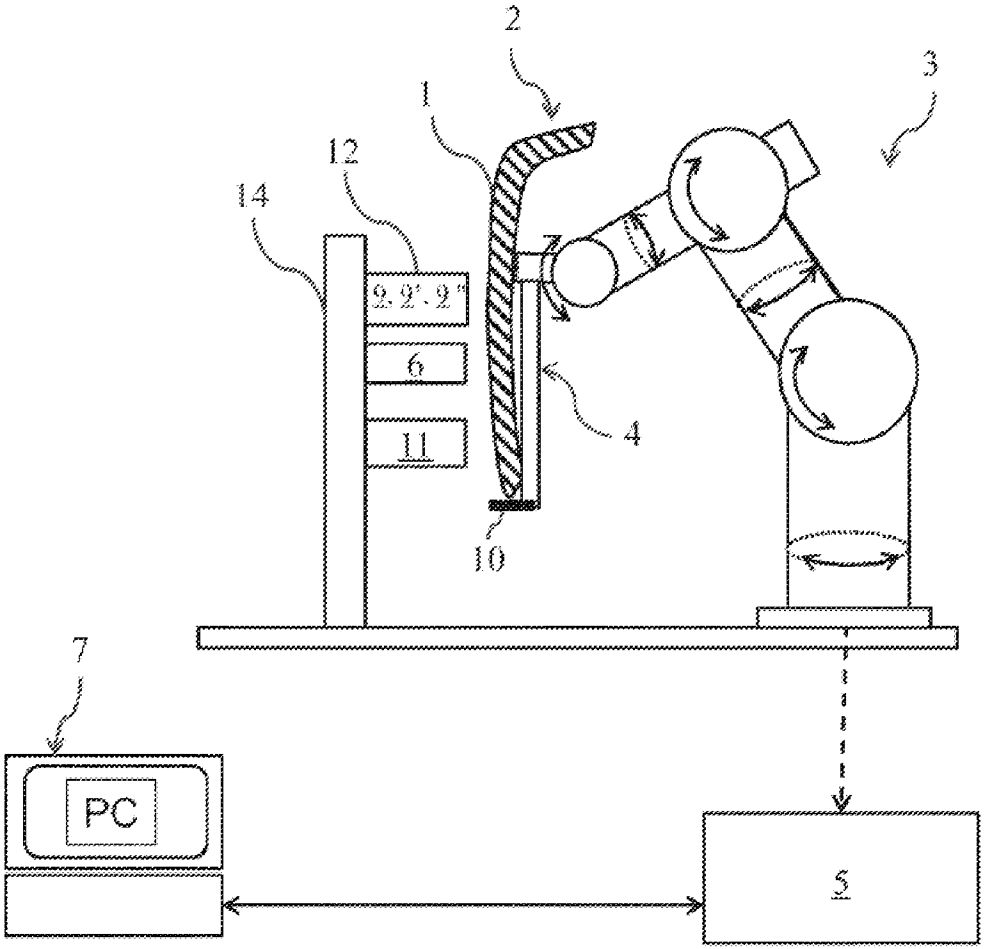
FIG. 1 is a view of a portion of the installation according to the invention.
Figure 2B:
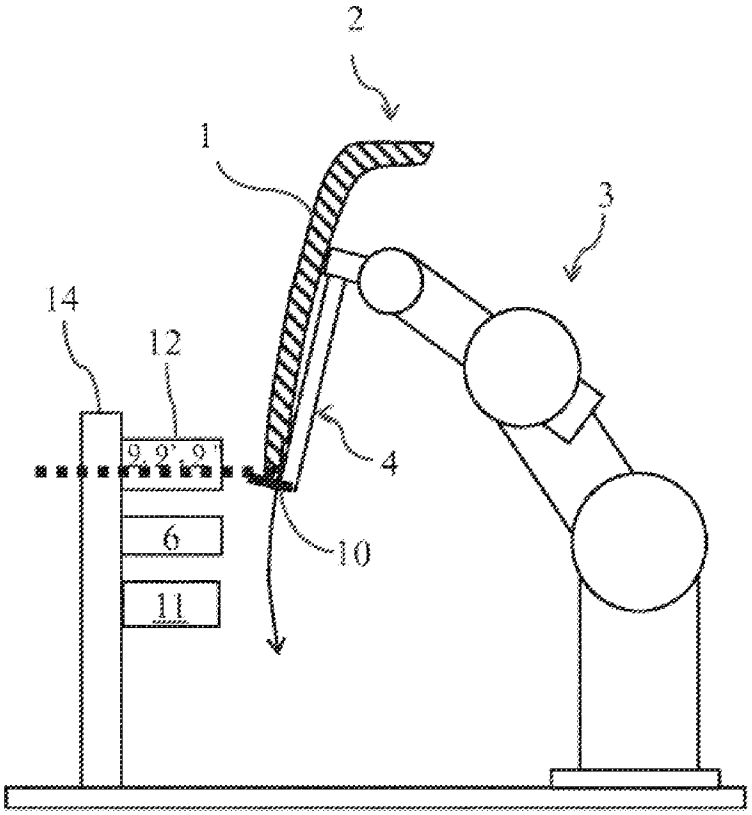
FIGS. 2A and 2B are views of the installation according to the invention, during the calibration step of the method according to the invention.
Figure 2A:
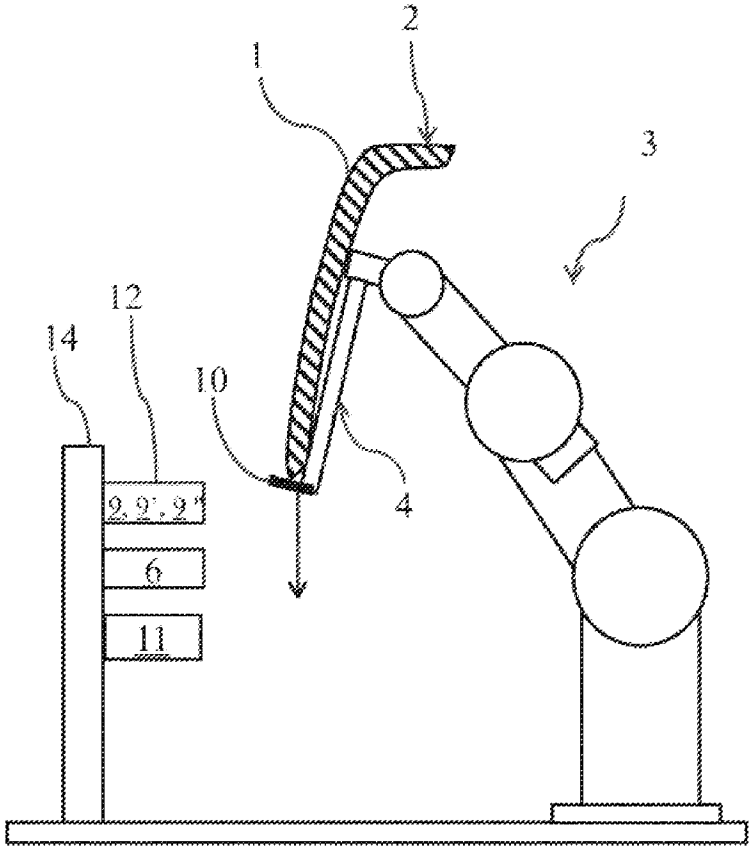

The method may comprise a calibration step, prior to the deposition step, during which a first detection sensor 9', fixed relative to the deposition means 6, can detect the passage of a reference or marking element 10 arranged on the part 2 or on the support 4 of the movement means 3, during the movement of the movement means 3, in order to determine the data relating to the spatial coordinates of the reference or marking element 10 (FIGS. 2A and 2B).

Advantageously, the spatial coordinates of the reference or marking element 10 thus determined may be transmitted and stored in relation to the data relating to the set of instantaneous velocities v1, v2, v3, v4, v5 in the computer 7, with a view to generating the pulse train signal S using the microcontroller 8. These spatial coordinates of the reference or marking element 10 correspond to a time reference of the pulse train signal S.

During the deposition step, a second detection sensor 9", fixed relative to the deposition means 6, can detect the passage of a reference or marking element 10 arranged on the part 2 or on the support 4 of the movement means 3, then can transmit a trigger signal SD to the microcontroller 8 in order to trigger the transmission of the pulse train signal S to the deposition means 6 in order to trigger the ejection of the substance 13 (FIGS. 4 and 6).

Advantageously, upon receiving the trigger signal SD, the microcontroller 8 returns the pulse train signal S to the deposition means 6, which makes it possible to synchronize the pulse train signal S with the kinematics of the movement means 3. Thus, by virtue of the reference or marking element 10, which can be precisely detected on the actual trajectory of the movement means 3, it is possible to give the order for the deposition means 6 to eject the substance 13 onto the part 2 at the right time and not before or after. The synchronization may advantageously be made possible by the passing of the part 2 by the second detection sensor 9". Preferably, the detection of the reference or marking element 10 may be performed at the start of the trajectory.

For example, the reference or marking element 10 may be a reflective surface (not shown) affixed to the surface 1 of the part 2 or to the support 4 of the movement means 3 and the first detection sensor 9' or the second detection sensor 9" may be an optical sensor. In this way, when the optical sensor and the reflective surface face one another, the optical sensor measures a variation in received light intensity.

The measurement sensor 9, the first detection sensor 9', and the second detection sensor 9" used may consist of a telemetry sensor module 12 which is fixed relative to the deposition means 6.

Advantageously, this telemetry sensor module 12 makes it possible in particular to remotely measure the instantaneous velocity v1, v2, v3, v4, v5 of the part 2.

For example, the measurement sensor 9, the first detection sensor 9', and the second detection sensor 9" may be optical sensors.

Preferably, the measurement sensor 9 is fixed relative to the deposition means 6. More precisely, the measurement sensor 9 is arranged in proximity to the deposition means 6. Preferably, the distance between the measurement sensor 9 and the deposition means 6 may be between 3 millimeters and 200 millimeters. Additionally, during the measurement step, the measurement sensor 9 is arranged substantially facing the fraction of the surface 1 of the part 2 for which the instantaneous velocities v1, v2, v3, v4, v5 have to be measured.

During the deposition step, the microcontroller 8 can transmit the pulse train signal S to the deposition means 6 at a period of between 20 and 100 microseconds.

The microcontroller 8 used may consist of a microcontroller comprising at least said storage memory (not shown) and a volatile memory (not shown).

The movement means 3 used may consist of a robot arm (not shown) comprising six axes of rotation.

Advantageously, this robot arm makes it possible to move the part 2 past the deposition means 6 and, more particularly, past the printheads (not shown) described below.

The axes of rotation and the movement of the robot arm are not fixed and completely free. This results in a great latitude of movement of the robot arm with respect to the geometry of the part 2.

During the deposition step, the deposition means 6 and the fraction of the surface 1 of the part 2 for which the instantaneous velocities v1, v2, v3, v4, v5 have been measured and on which the substance 13 is deposited are substantially facing one another.

The deposition means 6 used may consist of printing means comprising at least one printhead, preferably of the inkjet type, for ejecting and depositing at least the substance 13 in the form of drops.

In addition, because the deposition means 6 are stationary, the printheads may also be stationary and are easily accessible. This configuration facilitates the feeding of ink to the printheads. In addition, this results in a decrease in disruptions in the precision of the pattern to be deposited.

The printhead may however be mobile, but in a limited way, that is to say mobile in translation along three axes or in rotation, in order to adjust to the movement and to the geometry of the part 2.

The printhead can be single-color, two-color, or a four-color assembly.

The substance 13 may be chosen alone or in combination from among an ink, a color ink, an ultraviolet crosslinking ink, a varnish, a primer, an adhesion agent, a coupling agent, and a coating agent.

The deposition means 6 may generally comprise any type of effector (not shown) that makes it possible to treat the surface 1 of the part 2 using at least one substance 13.

Preferably, the printheads may comprise a plurality of nozzles (not shown) arranged on rails (not shown) which are arranged substantially perpendicular to the surface 1 of the part 2, at least during the deposition step.

The deposition means 6 may be associated with drying means 11 and during the deposition step, the drying means 11 may at least partially dry the substance 13 after deposition of the substance 13 on said at least a fraction of the surface 1 of the part 2.

Specifically, the drying means 11 may allow the partial drying of the drops ejected by the deposition means 6 in addition to the complete final drying.

For example, the drying means 11 may be an ultraviolet complete drying system.

The deposition means 6, the measurement sensor 9, the first detection sensor 9', the second detection sensor 9" and, where applicable, the drying means 11 may be mounted on the same base 14.

In accordance with the invention, the installation for surface-treating at least one surface 1 of a part 2 is characterized in that it is capable of and intended for implementing the method for surface-treating at least one surface 1 of a part 2 as described above and in that it comprises:

- movement means 3 capable of and intended for moving the part 2 relative to the deposition means 6, and the movement means 3 comprising a support 4 capable of and intended for fixing the part 2 relative to the movement means 3,
- a management and control unit 5 capable of and intended for controlling the movement of the movement means along a predetermined trajectory and according to a predetermined speed of movement, in a controlled manner,
- a measurement sensor 9 capable of and intended for determining a set of instantaneous velocities v1, v2, v3, v4, v5 over at least a fraction of the surface 1 of the part 2,
- the deposition means 6 being capable of and intended for ejecting a substance 13 onto the surface 1 of the part 2,
- a computer 7 capable of and intended for receiving and recording data representative of the set of instantaneous velocities v1, v2, v3, v4, v5,
- a microcontroller 8 capable of and intended for determining, from the data representative of the set of instantaneous velocities v1, v2, v3, v4, v5, a pulse train signal S representative of a set of frequencies of ejection of the substance 13 to be deposited by the deposition means 6, and for transmitting it to the deposition means 6 in order to eject the substance 13 according to the received pulse train signal S.

The installation may comprise a first detection sensor 9', fixed relative to the deposition means 6, capable of and intended for detecting the passage of a reference or marking element 10 arranged on the part 2 or on the support 4 of the movement means 3, in order to determine the data relating to the spatial coordinates of the reference or marking element 10.

The installation may comprise a second detection sensor 9", fixed relative to the deposition means 6, capable of and intended for detecting the passage of a reference or marking element 10 arranged on the part 2 or on the support 4 of the movement means 3, and then transmitting a trigger signal SD to the microcontroller 8 in order to trigger the transmission of the pulse train signal S to the deposition means 6 in order to trigger the ejection of the substance 13.

The measurement sensor 9, the first detection sensor 9', and the second detection sensor 9" may be a telemetry sensor module 12 which is fixed relative to the deposition means 6.

The measurement sensor 9, the first detection sensor 9', and the second detection sensor 9" may be as described above.

Preferably, the computer 7 is capable of and intended for converting the set of instantaneous velocities v1, v2, v3, v4, v5 into a series of pulse train periods T1, T2, T3, T4, T5 on the basis of the relationship Ti=(R/vi)/K, with i a natural whole number, R the printing resolution in millimeters, preferably between 0.04 millimeters and 4 millimeters, and K the oversampling coefficient, preferably between $10^6$ and $10^7$.

Preferably, the microcontroller 8 is capable of and intended for transforming the series of pulse train periods T1, T2, T3, T4, T5 into a pulse train signal S sampled at a sampling period Timp, preferably between 5 microseconds to 100 microseconds.

The microcontroller 8 may comprise at least one storage memory and a volatile memory.

The movement means 3 may consist of a robot arm comprising six axes of rotation.

This robot arm may be as described above.

The deposition means 6 may consist of printing means comprising at least one printhead, preferably of the inkjet type, for depositing at least the substance 13 in the form of drops.

These printing means and the printhead may be as described above.

The installation may comprise drying means 11 associated with the deposition means 6 and the drying means 11 may be capable of and intended for at least partially drying the substance 13 after deposition of the substance 13 on said at least a fraction on the surface 1 of the part 2.

The drying means 11 may be as described above. Of course, the invention is not limited to the embodiments described and shown in the appended drawings. Modifications remain possible, in particular from the point of view of the makeup of the various elements or by substituting technical equivalents, without thereby departing from the scope of protection of the invention.

The invention claimed is:

1. A method for surface-treating at least one surface of a part, said method comprising the steps of:

a measurement step, during which movement means, to which the part is secured at the level of a support forming part of the movement means, are moved at a speed of movement that varies according to the local geometry of the part, along a predetermined trajectory and, in a controlled manner, by a management and control unit, relative to deposition means which are not ejecting any substance, and during which a set of instantaneous velocities, over at least a fraction of the surface of the part, is determined by means of a measurement sensor controlled by the management and control unit, then data representative of this set of instantaneous velocities are transmitted and recorded in a computer, a signal processing step, subsequent to the measurement step, during which a microcontroller determines, from the data representative of the set of instantaneous velocities that were previously transmitted by the computer to the microcontroller, a pulse train signal representative of a set of frequencies of ejection of a substance to be deposited by the deposition means on said at least a fraction of the surface of the part, and records the pulse train signal in a storage memory of the microcontroller, a deposition step, subsequent to the signal processing step, during which the movement means are moved in a controlled manner, by the management and control unit relative to the deposition means, along the determined trajectory, and during which, in a synchronized manner, the microcontroller transmits the pulse train signal to the deposition means, and the deposition means eject at least one substance according to the received pulse train signal in order to deposit the substance on said at least a fraction of the surface of the part.

2. The method as claimed in claim 1, wherein during the measurement step, the management and control unit and the measurement sensor sequentially measure the instantaneous velocities, the various successive measurements being separated by a polling period which is constant or variable, preferably between 1 microsecond and 100 milliseconds.

3. The method as claimed in claim 1, wherein said method comprises a conversion step, subsequent to the measurement step and prior to the signal processing step, during which the computer converts the set of instantaneous velocities into a series of pulse train periods, on the basis of the relationship $Ti=(R/vi)/K$, with i a natural integer, R the printing resolution in millimeters, preferably between 0.04 millimeters and 4 millimeters, and K the oversampling coefficient, preferably between $10^6$ and $10^7$.

4. The method as claimed in claim 3, wherein during the signal processing step, the series of pulse train periods is transformed into a pulse train signal sampled at a sampling period, preferably between 5 microseconds to 100 microseconds, by the microcontroller.

5. The method as claimed in claim 1, wherein said method comprises a calibration step, prior to the deposition step, during which a first detection sensor, fixed relative to the deposition means, detects the passage of a reference or marking element arranged on the part or on the support of the movement means, during the movement of the movement means, in order to determine the data relating to the spatial coordinates of the reference or marking element.

6. The method as claimed in claim 1, wherein during the deposition step, a second detection sensor, fixed relative to the deposition means, detects the passage of a reference or marking element arranged on the part or on the support of the movement means, then transmits a trigger signal to the microcontroller in order to trigger the transmission of the pulse train signal to the deposition means in order to trigger the ejection of the substance.

7. The method as claimed in claim 5, wherein the measurement sensor, the first detection sensor, and the second detection sensor used consist of a telemetry sensor module which is fixed relative to the deposition means.

8. The method as claimed in claim 1, wherein during the deposition step, the microcontroller transmits the pulse train signal to the deposition means at a speed of between 20 and 100 microseconds.

9. The method as claimed in claim 1, wherein the microcontroller used consists of a microcontroller comprising at least said storage memory and a volatile memory.

10. The method as claimed in claim 1, wherein the movement means used consist of a robot arm comprising six axes of rotation.

11. The method as claimed in claim 1, wherein the deposition means used consist of printing means comprising at least one printhead, preferably of the inkjet type, for ejecting and depositing at least the substance in the form of drops.

12. The method as claimed in claim 11, wherein the deposition means are stationary and in that said at least one printhead is fixed or mobile in translation along three axes or in rotation.

13. The method as claimed in claim 11, wherein the deposition means are associated with drying means and in that during the deposition step, the drying means at least partially dry the substance after deposition of the substance on said at least a fraction of the surface of the part.

14. An installation for surface-treating at least one surface of a part, characterized in that it is capable of and intended for implementing the method for surface-treating at least one surface of a part as claimed in claim 1 and in that it comprises:

the movement means capable of and intended for moving the part relative to deposition means, and the movement means comprising the support capable of and intended for fixing the part relative to the movement means, the management and control unit capable of and intended for controlling the movement of the movement means along the predetermined trajectory and according to the predetermined speed of movement, in the controlled manner, the measurement sensor capable of and intended for determining the set of instantaneous velocities over at least the fraction of the surface of the part, the deposition means being capable of and intended for ejecting the substance onto the surface of the part, the computer capable of and intended for receiving and recording data representative of the set of instantaneous velocities, the microcontroller capable of and intended for determining, from the data representative of the set of instantaneous velocities, the pulse train signal representative of the set of frequencies of ejection of the substance to be deposited by the deposition means, and for transmitting it to the deposition means in order to eject the substance according to the received pulse train signal.

15. The installation as claimed in claim 14, wherein said installation comprises the first detection sensor, fixed relative to the deposition means, capable of and intended for detecting the passage of the reference or marking element arranged on the part or on the support of the movement means, in order to determine the data relating to the spatial coordinates of the reference or marking element.

16. The installation as claimed in claim 14, wherein said installation comprises the second detection sensor, fixed relative to the deposition means, capable of and intended for detecting the passage of the reference or marking element arranged on the part or on the support of the movement means, and then transmitting trigger signal to the microcontroller in order to trigger the transmission of the pulse train signal to the deposition means in order to trigger the ejection of the substance.

17. The installation as claimed in claim 15, wherein the measurement sensor, the first detection sensor, and the second detection sensor is the telemetry sensor module which is fixed relative to the deposition means.

18. The installation as claimed in claim 14, wherein the microcontroller comprises at least one storage memory and the volatile memory.

19. The installation as claimed in claim 14, wherein the movement means consist of the robot arm comprising six axes of rotation.

20. The installation as claimed in claim 14, wherein the deposition means consist of printing means comprising at least one printhead, preferably of the inkjet type, for depositing the at least the substance in the form of drops.

21. The installation as claimed in claim 20, wherein the deposition means are stationary and in that said at least one printhead is fixed or mobile in translation along three axes or in rotation.

22. The installation as claimed in claim 14, wherein said installation comprises drying means that are associated with the deposition means and in that the drying means are capable of and intended for at least partially drying the substance after deposition of the substance on said at least a fraction on the surface of the part.

* * * * *